US008495943B2

(12) United States Patent
Evans

(10) Patent No.: US 8,495,943 B2
(45) **Date of Patent: *Jul. 30, 2013**

(54) ANVIL FOR SUPPORTING CUTS IN SHEET AND ROLL STOCK

(75) Inventor: Richard B. Evans, Maple Valley, WA (US)

(73) Assignee: The Boeing Company, Chicago, IL (US)

( * ) Notice: Subject to any disclaimer, the term of this patent is extended or adjusted under 35 U.S.C. 154(b) by 982 days.

This patent is subject to a terminal disclaimer.

(21) Appl. No.: 10/829,269

(22) Filed: Apr. 22, 2004

(65) Prior Publication Data

US 2005/0235795 A1 Oct. 27, 2005

(51) Int. Cl.
*B26D 7/08* (2006.01)
*B26D 7/20* (2006.01)

(52) U.S. Cl.
USPC ..... 83/956; 83/347; 83/561; 83/701; 83/746

(58) Field of Classification Search
USPC ..... 83/561, 701, 956, 347, 28, 578, 614, 83/746; 156/353, 580.1, 580.2, 73.3, 73.1; 72/476, 710; 125/13.01, 16.01; 451/165; 74/1 SS
See application file for complete search history.

(56) References Cited

U.S. PATENT DOCUMENTS 3,645,304 A * 2/1972 Thrasher ..... 83/821
3,683,736 A * 8/1972 Loose ..... 83/16
3,788,175 A 1/1974 Davis
3,918,337 A 11/1975 Lindblad et al.
4,060,017 A 11/1977 Backlund
4,077,290 A * 3/1978 Hreha ..... 83/471.2
4,133,711 A 1/1979 August et al. ..... 156/353
4,208,238 A 6/1980 August et al. ..... 156/510
4,373,412 A 2/1983 Gerber et al.
4,438,698 A * 3/1984 Sullivan et al. ..... 101/287
4,867,023 A 9/1989 Kozyrski et al.
4,867,834 A 9/1989 Alenskis et al. ..... 156/433
4,920,495 A 4/1990 Pilkington
4,925,515 A * 5/1990 Yoshimura et al. ..... 156/250
5,028,052 A 7/1991 Miller
5,072,640 A * 12/1991 Greve et al. ..... 83/208
5,265,508 A * 11/1993 Bell et al. ..... 83/136
5,368,464 A * 11/1994 Stewart et al. ..... 425/174.2
5,480,508 A * 1/1996 Manabe et al. ..... 156/353
5,688,351 A 11/1997 Thomas ..... 156/214
5,944,924 A * 8/1999 Engle et al. ..... 156/73.3
6,048,353 A * 4/2000 Freed et al. ..... 606/184

(Continued)

OTHER PUBLICATIONS

Notice of Allowance, dated Nov. 2, 2012, regarding U.S. Appl. No. 12/205,573, 9 pages.

(Continued)

*Primary Examiner* — Laura M Lee
(74) *Attorney, Agent, or Firm* — Yee & Associates, P.C.

(57) ABSTRACT

To cut a backed ply material with an ultrasonic blade, an anvil is utilized to provide support. The backed ply material travels in a first direction, the ultrasonic blade includes a tip, and the ultrasonic blade is operable to travel along a path. This path is oriented in a transverse manner relative to the first direction. The anvil includes a rigid base for securing the anvil to a cutting assembly and a surface coinciding with the path. The surface is secured to the base. The anvil further includes a groove disposed upon the surface. This groove is in cooperative alignment with the tip.

8 Claims, 4 Drawing Sheets

U.S. PATENT DOCUMENTS

| | | | | |
|---|---|---|---|---|
| 6,152,003 | A * | 11/2000 | Jung | 83/74 |
| 6,637,490 | B1 * | 10/2003 | Azulay | 156/515 |
| 6,720,058 | B1 * | 4/2004 | Weeks et al. | 428/94 |
| 6,749,102 | B2 * | 6/2004 | Yamano et al. | 228/110.1 |
| 6,755,105 | B2 * | 6/2004 | Downing | 83/175 |
| 6,813,985 | B2 * | 11/2004 | Gharst et al. | 83/863 |
| 8,387,502 | B2 | 3/2013 | Evans | |
| 2004/0079208 | A1 * | 4/2004 | Carlson et al. | 83/13 |
| 2005/0081692 | A1 * | 4/2005 | Mosiewicz et al. | 83/508.3 |
| 2009/0000451 | A1 | 1/2009 | Evans | |

OTHER PUBLICATIONS

Evans, "Cutting Anvil and Method," U.S. Appl. No. 13/781,725 and Preliminary Amendment, filed Feb. 28, 2013, 27 pages.

Office Action, dated May 15, 2009, regarding U.S. Appl. No. 12/205,573, 15 pages.

Final Office Action, dated Oct. 15, 2009, regarding U.S. Appl. No. 12/205,573, 11 pages.

Office Action, dated Feb. 1, 2010 regarding U.S. Appl. No. 12/205,573, 11 pages.

Final Office Action, dated Jul. 16, 2010 regarding U.S. Appl. No. 12/205,573, 10 pages.

Office Action, dated Nov. 2, 2010 regarding U.S. Appl. No. 12/205,573, 9 pages.

Final Office Action, dated Apr. 13, 2011 regarding U.S. Appl. No. 12/205,573, 13 pages.

Office Action, dated Nov. 10, 2011 regarding U.S. Appl. No. 12/205,573, 11 pages.

Final Office Action, dated Jun. 22, 2012 regarding U.S. Appl. No. 12/205,573, 7 pages.

* cited by examiner

ANVIL FOR SUPPORTING CUTS IN SHEET AND ROLL STOCK

FIELD OF THE INVENTION

The present invention generally relates to an anvil for supporting cuts in sheet and roll stock. More particularly, the present invention pertains to an improved anvil for supporting cuts in composite ply material and its method of use.

BACKGROUND OF THE INVENTION

Composite structures are typically constructed from multiple layers or plies. These plies may include a variety of materials such as carbon fiber, various other fibers, metal foils, and the like. In addition, the plies may be pre-impregnated with a resin and are often dispensed from a roll or spool. In roll form, the ply material is referred to as "tape" and typically includes a paper backing film. This backing film generally prevents pre-impregnated ply material (prepreg) from adhering to itself and aids in handling the ply as the ply is applied to the tool and the layup. In particular, at the beginning and end of each ply placement, the ply material is generally cut to match the profile of the layup while the backing film is left intact. In this manner, the intact backing film is utilized to guide the severed ply on to the layup. During the layup process, the backing film is removed prior to placement of any subsequent ply. To provide support for the material being cut and facilitate cutting to a proper depth, an anvil is typically utilized. The anvil is situated on the opposite side of the tape from the cutting tool and lays along the cutting path or is controlled to move in unison with the cutting tool.

A disadvantage associated with conventional anvils is the relatively high precision required to install and prepare them for use. Minor deviations in height adjustment may result in incomplete cuts of the ply material or cutting of the backing film. In particular, cuts in the backing film, introduced during the ply cutting procedure, often serve as a starting point for a tear. As the backing film is removed, torn backing film may remain on the ply, may fowl the ply placement head, and/or may lead to breakage of the backing film.

Another disadvantage associated with conventional anvils is that essentially any contact between the cutting tool and the anvil while setting up the cutting assembly or during use may result in damage to the cutting tool and/or the anvil. Even apparently minor damage to the cutting tool may produce unsatisfactory cutting performance and thus, require cutting tool replacement or regrinding. Damage to the anvil typically manifests itself as score marks. These score marks may cause cutting problems resulting from an altered cutting surface and generally tend to increase the drag of the tape as the tape is fed through the tape laying head. Down time associated with replacement of the cutting tool and/or anvil wastes resources.

Accordingly, it is desirable to provide a anvil that is capable of overcoming the disadvantages described herein at least to some extent.

SUMMARY OF THE INVENTION

The foregoing needs are met, to a great extent, by the present invention, wherein in some embodiments an anvil that facilitates cutting ply material is provided.

An embodiment of the present invention relates to an anvil for providing support to a backed ply material being cut by an ultrasonic blade. The backed ply material travels in a first direction, the ultrasonic blade includes a tip, and the ultrasonic blade is operable to travel along a path. This path is oriented in a transverse manner relative to the first direction. The anvil includes a rigid base for securing the anvil to a cutting assembly and a surface coinciding with the path. The surface is secured to the base. The anvil further includes a groove disposed upon the surface. This groove is in cooperative alignment with the tip.

Another embodiment of the present invention pertains to a system for cutting a backed ply material with an ultrasonic blade. The system includes an ultrasonic cutting tool, and an anvil. The ultrasonic cutting tool includes a stylus. This stylus includes a tip. The anvil includes a first surface to support a backed ply material at a first height, a second surface to support the backed ply material at a second height, and a third surface in cooperative alignment with the tip. The third surface is disposed between the first surface and the second surface. The third surface provides support for the backing at a third height and the third height is relatively below the first height and the second height.

Yet another embodiment of the present invention relates to a method of generating an anvil. The anvil provides support for a stylus of a cutting assembly while cutting a backed ply material. In this method an anvil blank is disposed in the cutting assembly. This anvil blank includes a carvable, dimensionally stable, rigid, and wear resistant material. The anvil blank further includes an axis disposed in a perpendicular direction relative to a direction of travel of the backed ply material. Additionally, in the method the stylus is set to contact the anvil blank and the stylus is drawn along the axis. In this manner, the stylus generates a groove in the anvil blank. Furthermore, in the method, a depth of the groove is determined and the setting and drawing steps are repeated in response to the depth being less than a predetermined minimal depth.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

The present invention provides, in some embodiments, a cutter assembly, an anvil for the cutter assembly, and a method of generating the anvil. In an embodiment, the invention provides for an anvil for cutting a backed ply material.

Figure 1:
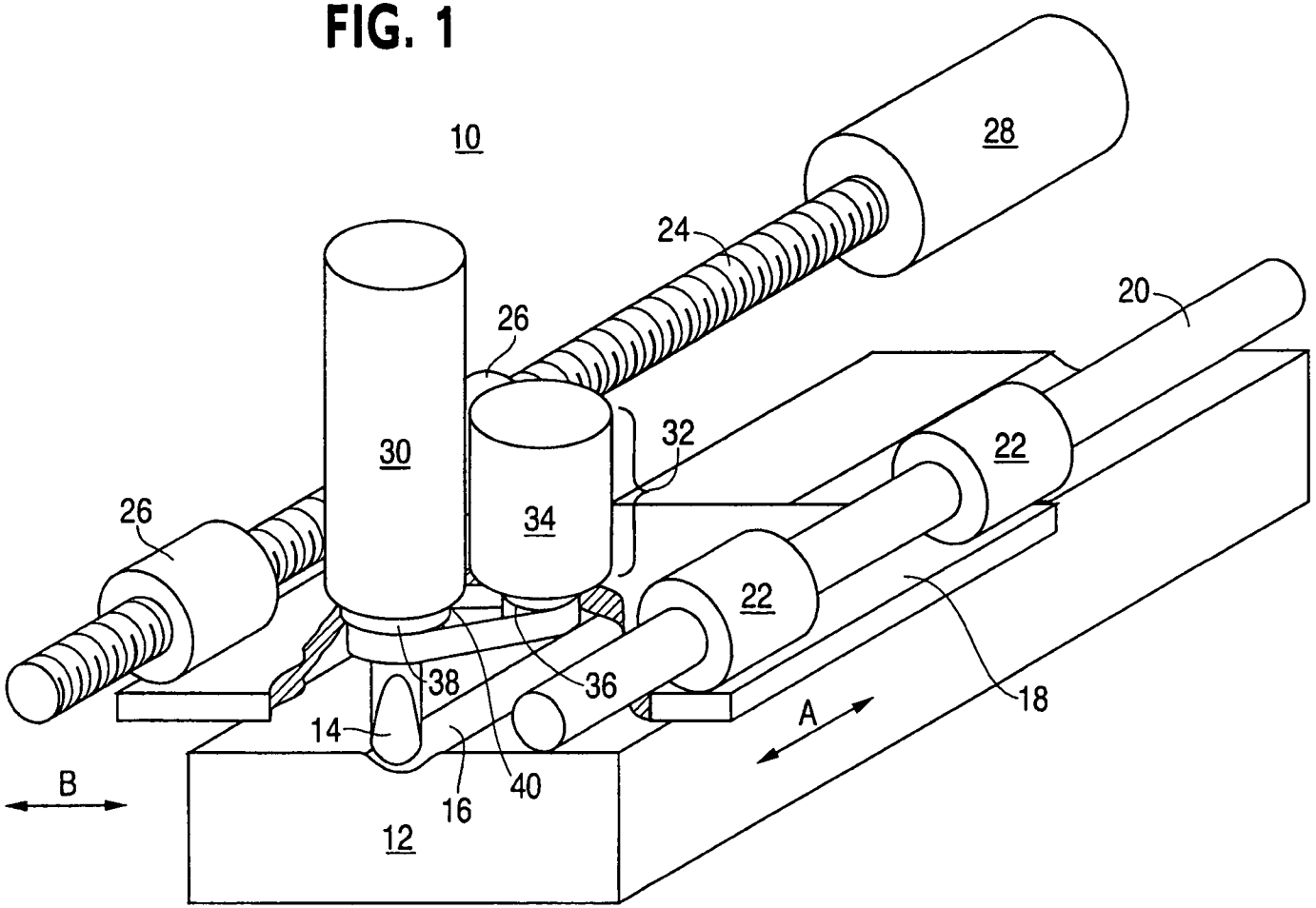
FIG. 1 is perspective view of a cutter assembly according to an embodiment of the invention.

The invention will now be described with reference to the drawing figures, in which like reference numerals refer to like parts throughout. As shown in FIG. 1, a cutting assembly 10 includes an anvil 12 and a stylus 14. The anvil 12 and the stylus 14 are juxtaposed in co-operative alignment to facilitate cutting of ply material. That is, the anvil 12 provides support for the ply material and thereby facilitates the cutting action of the stylus 14. In various embodiments of the invention, the anvil 12 includes a groove 16 cooperatively aligned with the stylus 14. In a particular embodiment shown in FIG. 1, the groove 16 is coincidental with a path of the stylus 14. In this regard, the stylus 14 is mounted to a platform 18. Movement of this platform 18 may be controlled in any suitable manner. Examples of suitable movement control systems generally include guide and/or actuating devices such as rails, rack and pinions, linear drive belts, linear slides, X-Y tables, pneumatic rams, linear actuators, various armatures, and the like.

In a particular example shown in FIG. 1, the movement of the platform 18 is controlled by the action of a guide bar 20, pillow blocks 22, lead screw 24, and pillow blocks 26. The pillow blocks 22 slidably engage the guide bar 20. The pillow blocks 26 are tapped to mate with the threads of the lead screw 24. In addition, a stepper motor 28 is controlled to rotate the lead screw 24 and thereby modulate the position of the stylus 14 along the groove 16. In this manner, the stylus 14 is controlled to move as indicated by direction A.

Depending upon the material to be cut and/or the particular application, the cutting assembly 10 may further include and ultrasonic transducer 30 and stylus orientation assembly 32. The ultrasonic transducer 30 generates vibrational energy that is transmitted through the stylus 14 and thereby facilitate cutting of various materials. The stylus orientation assembly 32 includes a stepper motor 34, pulleys 36 and 38, and belt 40. To modulate the orientation of the stylus 14, the stepper motor 32 is controlled to rotate the pulley 36. This rotation is transferred via the belt 40 to the pulley 38 which, in turn, causes the rotation of the stylus 14.

In operation, a sheet of ply material or backed ply material is fed between the platform 18 and the anvil 12 and generally controlled to move as indicated by direction B. By controlling the movement of the ply material in conjunction with the movement of the various components of the cutting assembly 10, the cutting assembly 10 is controllable to generate slitting cuts, butt cuts, tapers, curves, and the like.

Figure 2:
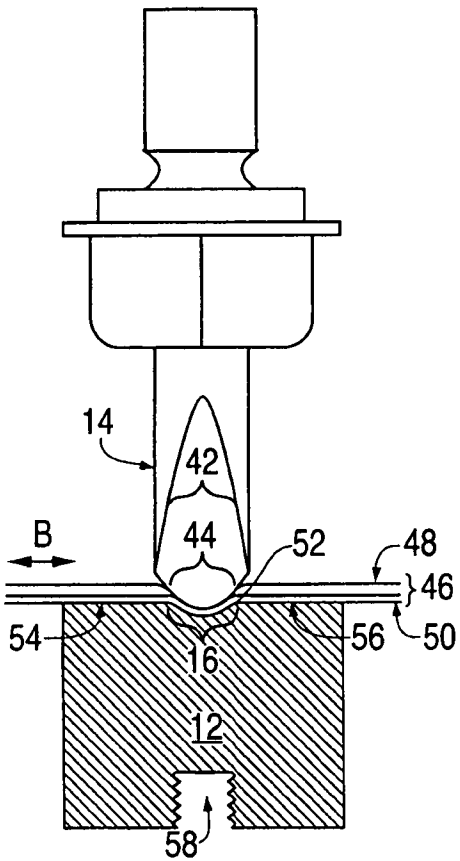
FIG. 2 is a side view of an anvil according to an embodiment of the invention.

FIG. 2 is a cross sectional view of the anvil 12 according to an embodiment of the invention. In the embodiment shown in FIG. 2, the anvil 12 is essentially a single piece of suitable material. Materials suitable for use in the anvil 12 include relatively stable, strong and/or wear resistant materials such as, for example: metals and/or metal alloys; laminates; plastics; phenolic resins; and the like. In a particular example, the anvil 12 may be formed from steel.

Another material for use in the anvil 12 includes any suitable dimensionally stable, rigid and/or wear resistant material. Particular examples of such suitable materials include MICARTA® and other such high pressure laminates produced by Industrial Laminates/Norplex, Inc. of Postville, Iowa 52162, USA. An advantage of the use of high pressure laminates is that contact between the stylus 14 and a high pressure laminate tends to have fewer negative effects than contact between the stylus 14 and a relatively hard metal. In addition, in an embodiment of the invention, it is preferable that the material for use in the anvil 12 be readily carved or scraped as well as dimensionally stable, rigid and/or wear resistant. In this embodiment described herein, the stylus 12 may be utilized to generate the groove 16 in the insert 60. In this manner, the groove 16 may essentially correspond to a profile of the tip 44.

As shown in FIG. 2, the anvil 12 includes the groove 16. As stated herein, the groove 16 is cooperatively aligned with the stylus 14. In particular, the groove 16 is aligned with an edge 42 of the stylus 14 and, more particularly, the groove 16 is aligned with a tip 44 of the stylus 14.

According to an embodiment of the invention, the cutting assembly 10 is operable to cut a backed ply material 46. In this regard, the backed ply material 46 includes a ply 48 and a backing 50. In various embodiments of the invention, the ply material 46 may include any suitable sheet stock. Examples of suitable sheet stocks include: woven fiber fabric; oriented strand tape; metal foil such as aluminum alloy and titanium foil; composite materials such as titanium graphite metal-fiber laminates; and the like. In a particular embodiment, the ply material 48 is a graphite fiber tape pre-impregnated with an epoxy or toughened epoxy resin (pre-preg). In another particular embodiment, the ply material 48 is a toughened epoxy resin coated titanium foil. In general, the backing 50 lends support to the ply material 48 and aids in handling the ply material 48. In this regard, during layup operations, the backing 50 is typically removed. Examples of suitable backing materials generally include conventional backing materials as well as resilient, compliant, or materials otherwise polymeric in nature. For the purpose of this disclosure, the terms, "polymeric" and "polymer" and variations thereof are defined as a chemical compound or mixture of compounds formed by a chemical reaction in which two or more molecules combine to form a larger molecule that includes repeating structural units. In addition, other examples of suitable backing material and backed ply material may be found in co-pending U.S. patent application Ser. No. 10/829,270, entitled, "Backing Film and Method for Ply Materials", having inventor Richard B. Evans, and having a filing date of Apr. 22, 2004, the disclosure of which is hereby incorporated by reference in its entirety.

Figure 3:
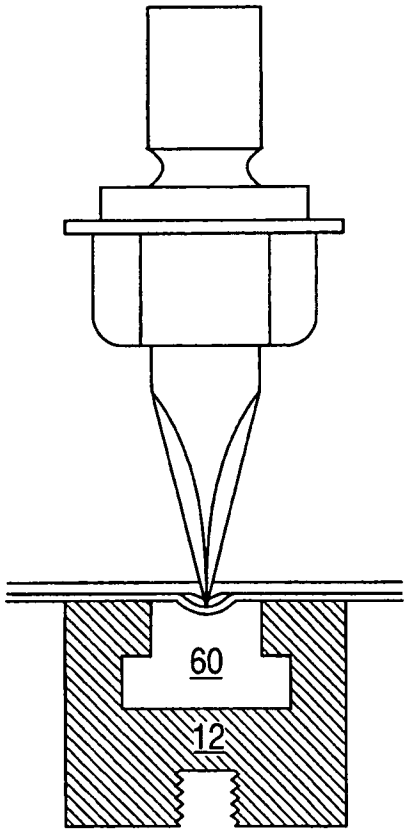
FIG. 3 is a side view of an anvil according to another embodiment of the invention.

In operation, the backed ply material 46 is moved, relative to the stylus 14. Oriented as indicated by the direction B, the cutting assembly 10 is configured to produce a slitting operation. As shown in FIG. 3, the stylus 14 is oriented to produce a butt cut. That is, the stylus 14 is drawn across the backed ply material 46 while the backed ply material 46 remains essentially stationary. In addition, taper cuts may be produced by disposing the stylus 14 at a desired orientation and moving both the stylus 14 and the backed ply material 46 in a substantially simultaneous and cooperative manner. During the various operations, the ply material 48 is cut while the backing 50 passes between the tip 44 and the groove 16. In this regard, according to an embodiment of the invention, the stylus 14 and the anvil 12 do not touch during ply cutting operations. That is, a gap 52 is substantially maintained between the edge 44 and the groove 16. This gap 52 is generally set prior to ply cutting operations. It is an advantage of some embodiments of the invention that the cutting assembly 10 properly cuts the ply 48 without cutting the backing 50 through a greater range of gap settings than conventional cutting assemblies. As such, setting the gap 52 is relatively easier and faster than setting the gap in conventional cutting assemblies.

Optionally, the anvil 12 includes a pair of transition surfaces 54 and 56 and a tapped bore 58. The transition surfaces 54 and 56, if present, facilitate alignment of the groove 16 with any suitable surface and/or tape guide. That is, according to an embodiment of the invention, the cutting assembly 10 is installed within a tape chute of a tape laying head. The tape chute includes surfaces and/or devices that guide the tape through the tape chute. When the anvil 12 is installed in the tape laying head, the groove 16 is typically aligned with the surfaces and/or devices that guide the tape through the tape chute. In some embodiments, the transition surfaces 54 and 56 facilitate this alignment. However, in other embodiments, the groove 16 aligned without the surfaces and/or devices that guide the tape through the tape chute.

The tapped bore 58, if present, facilitates securing the anvil 12 to the cutting assembly 10. For example, a threaded bolt configured to engage the tapped bore 58, may be utilized to secure the anvil 12 to a case or frame member of the cutting assembly 10 and/or other such structures of a tape laying head. However, the anvil 12 need not be secured in this manner, but rather, the anvil 12 may be secured relative to the stylus 14 via any suitable fastening device.

FIG. 3 is a side view of the anvil 12 according to another embodiment of the invention. The embodiment illustrated in FIG. 3 is similar to the embodiment illustrated in FIG. 2. Therefore, in the interest of brevity, those elements described in FIG. 2 will not be described again with reference to FIG. 3. As shown in FIG. 3, the anvil 12 includes an insert 60. The insert 60 is secured to the anvil 12 in any suitable manner. For example, according to an embodiment of the invention, the insert 60 is machined to mate with a "T" slot machined into the anvil 12. In this manner, the insert 60 may be removably secured without the aid of an adhesive. In another example, the insert 60 may be affixed to the anvil 12 with an adhesive or mechanical fastener. Material for use as the insert 60 include any suitable materials having relatively good wear properties and a relatively low coefficient of friction. Examples of suitable materials generally include plastics, resins, and the like. Specific examples of suitable materials include one or more of: ultra high molecular weight (UHMW) polyethylene polymers; DELRIN®; nylon, acetal; and the like.

Figure 4:
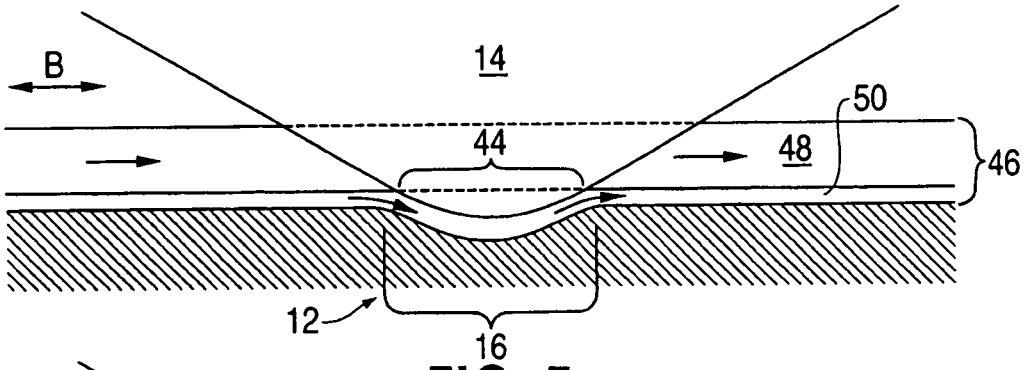
FIG. 4 is a side view of an interface between an anvil and a stylus in a slitting orientation according to an embodiment of the invention illustrated in FIG. 2.

FIG. 4 is a side view of an interface between the anvil 12 and the stylus 14 in a slitting orientation according to an embodiment of the invention illustrated in FIG. 2. As shown in FIG. 4, the path taken by the ply 48 and the backing 50 diverge slightly at the interface between the groove 16 and the tip 44. In this regard, in a preferred embodiment, the backing 50 is relatively more flexible than the ply 48. In a particular example where the ply 48 is a relatively rigid metal film such as toughened epoxy coated titanium foil, the backing 50 is relatively more flexible than the ply 48.

Figure 5:
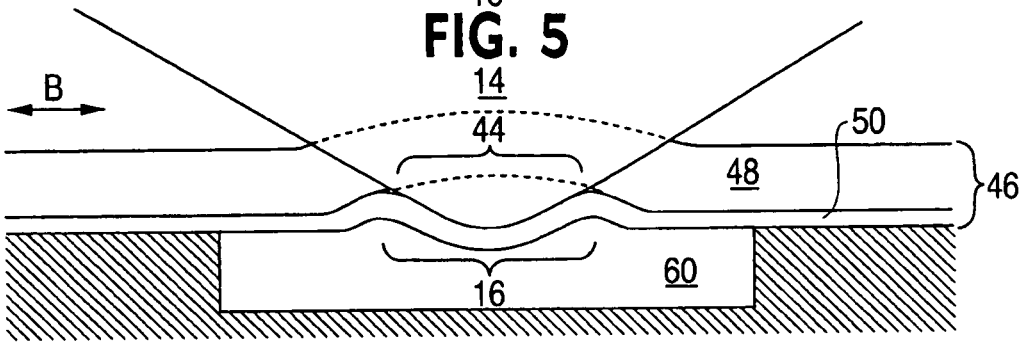
FIG. 5 is a side view of an interface between an anvil and a stylus in a slitting orientation according to yet another embodiment of the invention.

FIG. 5 is a side view of an interface between the anvil 12 and the stylus 14 in a slitting orientation according to yet another embodiment of the invention. As shown in FIG. 5, the insert 60 is readily deformable or compliant. That is, force exerted by the tip 44 upon the insert 60 generates the groove 16. In particular, the force exerted by the tip 44 may be translated via the backing 50 upon the insert 60. Additionally, the insert 60 of this embodiment is a "bond layer" of compliant material. For example, any suitably compliant material may be glued or otherwise affixed to the anvil 12. In this manner, a relatively flexible and resilient material may be affixed to a relatively rigid base. A particular example of a suitably compliant material includes a VYON® membrane manufactured by Porvair Technologies of the United Kingdom.

Figure 6:
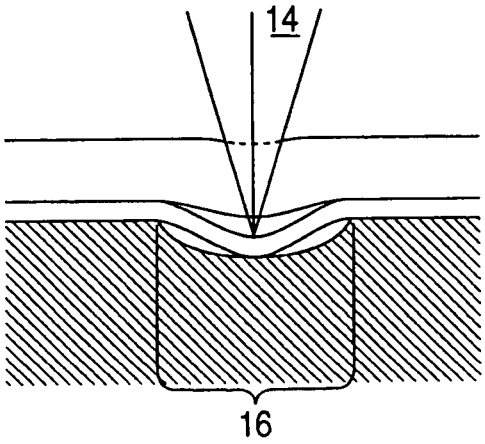
FIG. 6 is a side view of an interface between an anvil and a stylus in a butt cutting orientation according to an embodiment of the invention illustrated in FIG. 2.
Figure 7:
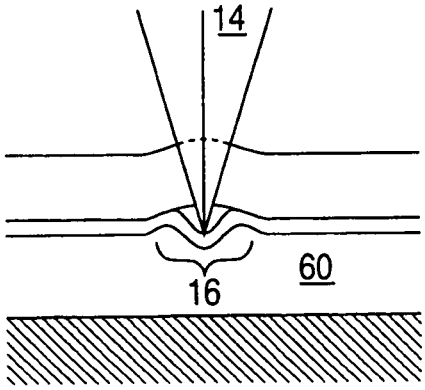
FIG. 7 is a side view of an interface between an anvil and a stylus in a butt cutting orientation according to an embodiment of the invention illustrated in FIG. 3.

According to an embodiment of the invention, by utilizing a compliant material in the insert 60, the groove 16 varies in response to modulations of the stylus 14 and/or the backed ply material 46. That is, when the stylus 14 is in a slitting orientation, the groove 16 is shaped generally as shown in FIG. 5, for example. In contrast, when the stylus 14 is in a butt cutting orientation, the groove 16 is shaped generally as shown in FIG. 7, for example. In this manner, the shape of the groove 16 is modulated in response to the stylus 14. However, in other embodiments of the invention, the groove 16 need not conform to the stylus 14. In this regard, FIG. 6 is a side view of an interface between the anvil 12 and the stylus 14 in a butt cutting orientation according to an embodiment of the invention illustrated in FIG. 2. As shown in FIG. 6, the groove 16 does not conform to the stylus 14.

Figure 8:
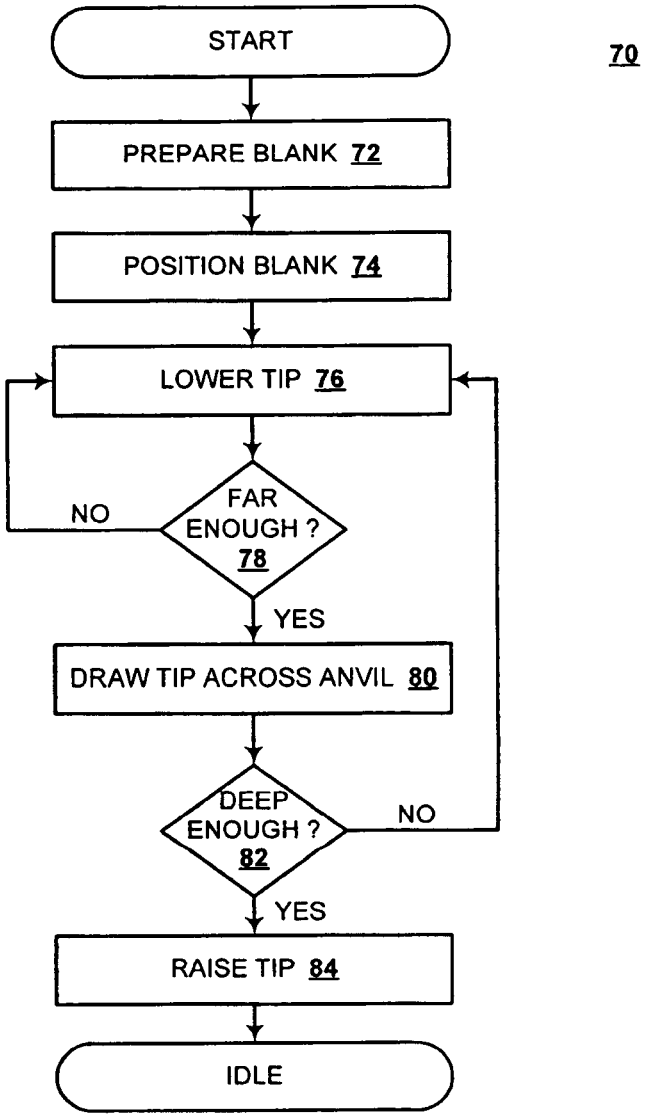
FIG. 8 is a flow diagram for a method of generating an anvil according to an embodiment of the invention.

FIG. 8 is a flow diagram for a method 70 of generating the anvil 12 according to an embodiment of the invention. In this embodiment, the cutting assembly 10 is utilized to generate the anvil 12. Prior to initiation of the method 70, a variety of preparative operations may be performed. For example, the cutting assembly 10 may be powered, materials and various components may be gathered, the stylus 14 may be oriented in a slitting configuration, and the like.

At step 72 a "blank" for the anvil 12 is prepared. In this regard, a, "blank" is essentially an anvil similar to the anvil 12 illustrated in FIG. 2 that substantially lacks the groove 16 is prepared for installation into the cutting assembly 10. This blank preferably includes a material that may be cut, scraped, and/or otherwise carved by the tip 44 without causing appreciable damage to the tip 44. Depending upon the particular configuration of the cutting assembly, an addition preparation for the blank may include milling and tapping the bore 58, milling and/or finishing the transition surfaces 54 and 56, and the like.

At step 74 the blank is secured to the cutting assembly 10. For example, one or more bolts may be utilized to fasten the blank to the cutting assembly 10. In addition, the position of the blank may be modulated by various leveling devices such that the transition surfaces are properly positioned.

At step 76 the tip 44 is lowered towards the blank. The method of lowering the tip 44 towards the blank is dependent upon the particular configuration of the cutting assembly 10. In this regard, the invention is not limited by the method of lowering the tip, nor is the term, "lowering" to be construed as limiting, but rather, any suitable manner of controlling the tip 44 and the blank to be drawn towards one another are within the purview of the invention.

At step 78 it is determined whether the tip 44 has been lowered sufficiently. In general, the tip 44 is to drive into the blank to a predetermined depth. This predetermined depth is based on a variety of factors such as, for example: hardness of the blank, friability of the blank, hardness of the tip 44, durability of an edge of the tip 44, power of the various drive mechanisms of the cutting assembly 10, and the like. Generally, the predetermined depth is such that, when the tip 44 is draw across the blank at step 80, a relatively smooth groove is generated. As such, the predetermined depth is dependent generally upon the material characteristics of the blank and the tip 44 as well as the angle the tip 44 meets the blank and the speed at which the tip 44 is drawn across the blank. In a particular embodiment, the tip 44 is driven about 1 to 3 thousandths of an inch into the blank. If it is determined that the tip 44 has not been lowered to the predetermined depth, the tip 44 is lowered further at step 76. If it is determined that the tip 44 has been lowered to the predetermined depth, the tip 44 is drawn across the blank at step 80.

At step 80 the tip 44 is drawn across the blank. For example, the tip 44 is controlled to move relative to the blank as indicated by direction A as shown in FIG. 1. In this manner, material from the blank is scraped or otherwise removed from the surface of the blank to generate the groove 16.

At step 82 it is determined whether the groove 16 is a predetermined depth. The predetermined depth of the groove 16 is dependent upon a variety of factors such as, for example: the material of the backing 50, the thickness of the backing 50, the configuration of the tip 44, the material characteristics of the ply 48, and the like. In general, the depth of the groove 16 is related to the thickness and material characteristics of the backed ply material 46. In an embodiment of the invention, the backing 50 is a relatively flexible, resilient material about 4 thousandths of an inch thick. In this embodiment, the predetermined depth of the groove 16 is about 3 thousandths of an inch deep. If it is determined that the groove 16 is not the predetermined depth, the tip 44 is lowered further at step 76. If it is determined that the groove 16 is the predetermined depth, the tip 44 is raised at step 84.

At step 84 the tip 44 is raised in preparation to perform ply cutting operations. It is an advantage of some embodiments of the present invention that setting the height of the tip 44 relative to the anvil 12 requires relatively less precision than in cutter assemblies employing conventional anvils. As such setup time is correspondingly reduced. Following this tip raising procedure, the cutting assembly idles or is shut down until ply cutting or other such operations are performed.

In addition, other embodiments of the invention include methods of generating the anvil 12 and/or the groove 16 that differ from that of the method 70. In particular, the groove 16 may be cast or milled into various metals. For example, a computer numerically controlled (CNC) milling machine may be instructed to mill the groove 16 into the anvil 12.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A system having an anvil and an ultrasonic blade, the anvil for providing support to a backed ply material during a cutting operation by the ultrasonic blade, the backed ply material traveling in a first direction and comprising a ply and a backing, the backing being relatively more flexible than the ply, the ultrasonic blade having a cutting profile, the ultrasonic blade being operable to travel along a cutting path, the cutting path being oriented in a transverse manner relative to the first direction, the anvil comprising:

a rigid base for securing the anvil to a cutting assembly;

an inverted "T" shaped channel in the rigid base and coinciding with the cutting path;

a "T" shaped insert that mates with the channel;

a surface on the insert to support the backed ply material; and a groove disposed upon the surface and coinciding with the cutting path, the groove being formed in the insert prior to any cutting operation by the ultrasonic blade and having a curved profile corresponding to a tip portion of the cutting profile of the ultrasonic blade, the groove providing support for the backing of the backed ply material during the cutting operation such that the ply and the relatively more flexible backing of the backed ply material diverge at an interface between the groove and the tip portion of the cutting profile of the ultrasonic blade, and the backing is urged into the groove during the cutting operation, the ultrasonic blade cutting the ply without cutting the backing during the cutting operation.

2. The system according to claim 1, wherein the rigid base comprises a metal base.

3. The system according to claim 2, wherein the metal base comprises a steel base.

4. The system according to claim 1, wherein the insert comprises a high pressure laminate.

5. The system according to claim 1, wherein the insert comprises a polymeric material.

6. The system according to claim 5, wherein the polymeric material comprises an ultra high molecular weight polymer.

7. The system according to claim 5, wherein the polymeric material comprises nylon.

8. The system according to claim 1, wherein the groove has a predetermined depth, the predetermined depth being a function of a thickness and material characteristics of the backed ply material.

* * * * *